United States Patent [19]

Gallacher et al.

[11] Patent Number: 5,023,016

[45] **Date of Patent: * Jun. 11, 1991**

[54] THERMALLY STABLE SULFONATE COMPOSITIONS

[75] Inventors: Lawrence V. Gallacher, Norwalk, Conn.; Alfen J. Gustavsen, Ballwin, Mo.; Robert L. Kugel, Norwalk, Conn.

[73] Assignee: King Industries, Inc., Norwalk, Conn.

[ * ] Notice: The portion of the term of this patent subsequent to Jan. 23, 2007 has been disclaimed.

[21] Appl. No.: 440,872

[22] Filed: Nov. 22, 1989

Related U.S. Application Data

[63] Continuation of Ser. No. 26,077, Mar. 16, 1987, Pat. No. 4,895,674.

[51] Int. Cl.[5] ..... C23F 11/10

[52] U.S. Cl. ..... 252/389.52; 252/389.61; 252/389.62; 252/33.2; 252/75; 252/387; 252/396; 252/18; 252/40; 252/33.3

[58] Field of Search ..... 252/18, 40, 389.61, 252/389.62, 75, 33.2, 33.3, 387, 396, 389.52

[56] References Cited

U.S. PATENT DOCUMENTS

| | | | |
|---|---|---|---|
| 2,322,307 | 6/1943 | Neely et al. | 252/33.3 X |
| 2,755,247 | 7/1956 | Dilworth et al. | 252/33.3 |
| 2,755,256 | 7/1956 | Dilworth et al. | 252/33.3 |
| 2,764,548 | 9/1956 | King et al. | 252/389.52 X |
| 2,816,842 | 12/1957 | Westland, Jr. et al. | 106/14.28 |
| 2,836,499 | 5/1958 | Lyons | 106/14.28 |
| 2,840,477 | 6/1958 | Shock et al. | 106/14.28 |
| 2,856,362 | 10/1958 | Morway | 252/33.3 X |
| 3,090,750 | 5/1963 | Bergen et al. | 252/33.3 X |
| 3,485,858 | 12/1969 | Gee et al. | 242/389.52 X |
| 3,623,983 | 11/1971 | Pattenden et al. | 252/33.4 |
| 3,625,894 | 12/1971 | Koenig et al. | 252/33.4 |
| 3,629,109 | 12/1971 | Gergel | 252/33.2 X |
| 3,671,430 | 6/1972 | Corringer | 252/33.3 X |
| 3,684,726 | 8/1972 | Haak et al. | 252/33.2 |
| 3,763,042 | 10/1973 | Gannon et al. | 252/21 |
| 3,816,316 | 6/1974 | Griffith, III et al. | 252/75 X |
| 3,957,859 | 5/1976 | Thielcke | 206/5.05 P |
| 4,164,474 | 8/1979 | Gallacher et al. | 44/76 X |
| 4,201,681 | 5/1980 | Lipinski et al. | 252/33.2 |
| 4,326,972 | 4/1982 | Chamberlin, III | 252/33.3 x |
| 4,419,251 | 12/1983 | Shim | 252/33.3 X |
| 4,419,252 | 12/1983 | Shim | 252/33.3 X |
| 4,592,851 | 6/1986 | Stadtmiller et al. | 252/32.7 E |

OTHER PUBLICATIONS

Nose et al, Chemical Abstracts, 79(26): 147965h, "Oil Rustproofing Compositions", 1973, p. 82.

*Primary Examiner*—Deborah L. Kyle
*Assistant Examiner*—Valerie Fee
*Attorney, Agent, or Firm*—Hedman, Gibson, Costigan & Hoare

[57] ABSTRACT

A concentrate composition is disclosed which comprises (a) a blend of (i) a metal sulfonate and (ii) an alkali or alkaline earth metal or zinc salt of a carboxylic acid and (b) a carrier. The composition is useful as a rust- and corrosion-inhibitor in a petroleum or synthetic base medium and is capable of maintaining metal sulfonate content at temperatures greater than 150° C., e.g., 200° C., for 20 hours.

25 Claims, No Drawings

THERMALLY STABLE SULFONATE COMPOSITIONS

This is a continuation of application Ser. No. 07/026,077 filed Mar. 16, 1987, now U.S. Pat. No. 4,895,674.

This invention relates to thermally stable sulfonate compositions. More particularly, it is concerned with concentrate compositions adapted for use as rust-and-corrosion inhibitor packages in petroleum or synthetic media and which can maintain sulfonate content at high temperatures, i.e., greater than 150° C., e.g., 200° C., for 21 hours.

BACKGROUND OF THE INVENTION

Alkali metal and alkaline earth metal salts of high molecular weight alkaryl and petroleum sulfonic acids have long been widely used as dispersants and rust or corrosion inhibitors in a number of applications such as in lubricating oils, greases and rust-preventative coatings.

It has also been reported that alkali metal and alkaline earth metal sulfonates can be combined with carboxylic acids, esters or soaps to enhance corrosion inhibiting properties, e.g., U.S. Pat. Nos. 3,623,983; 3,625,894; 3,684,726; 3,763,042; 4,201,681 and Japanese Patent Publication 48/12238.

In U.S. Pat. No. 3,623,983, Pattenden et al. disclose rust inhibiting penetrating oil compositions comprising as a rust preventative 3 to 25 weight percent of alkali metal and alkaline earth metal hydrocarbon sulfonates, carboxylic acids or oxidized paraffin, 50 to 85 weight percent of mineral base oil carrier, and 10.5 to 50 weight percent of a penetrating solvent. These oil penetrating compositions which contain a minor proportion of the active, i.e., non-carrier, components are stated to be useful when applied to highly corroded or frozen nuts on threaded bolts, but there is no indication that continuous lubrication or corrosion and rust-prevention can be achieved with such compositions at high temperatures for prolonged periods of time.

In U.S. Pat. No. 3,625,894, Koenig et al. describe lubricating compositions combined with an anticorrosive consisting of an alkaline earth metal petroleum sulfonate and/or an oil-soluble alkaline earth metal salt of a $C_{10}$–$C_{36}$ fatty acid and/or an oil-soluble alkaline earth metal salt of an alkyl-sulfamido-carboxylic acid, and benzotriazol. Although the compositions disclosed in the '894 patent are said to provide protection against corrosion for lubricants and mineral oils that have to withstand extreme temperatures, e.g., turbine oils, up to 170° C., only a temperature of 100° C. for 100 hours is exemplified.

Haak et al., U.S. Pat. No. 3,684,726 teach the inclusion of synergistic mixtures of barium alkaryl sulfonates and a naphthenate salt of zinc, lead, lithium or magnesium to improve the anti-corrosion properties of lubricating greases comprised of a metal soap and mineral oil. There is no disclosure in this patent however, that the thermal stability of such greases can be enhanced.

Gannon et al., U.S. Pat. No. 3,763,042 describe clay-thickened greases containing synergistic proportions of zinc dialkylnaphthalene sulfonate, an ester of an aliphatic monohydric alcohol and an aliphatic $C_{12}$–$C_{24}$ monocarboxylic acid and zinc naphthenate. Thermal stability is cited as one of the substantially improved properties of the '042 compositions. In the examples, however, lubricity, corrosion and pumpability properties are only tested at temperatures in the range of 54.4° C. to 176.6° C. See Tables I and II.

In U.S. Pat. No. 4,201,681, Lipinski et al. disclose a metal-working lubricant composition comprising a mineral oil and an additive combination of barium lanolate soap and barium sulfonate, e.g., barium didodecyl benzene sulfonate. The compositions of Lipinski et al. are tested for a number of characteristics, e.g., corrosion, stain and drawing properties, stack test for stain and friction measurements, visual observation for galling and scoring, however no enhanced stability to heat exposure was investigated or demonstrated. Moreover, no concentrates of active ingredients were prepared or diluted.

In Japanese Patent Publication No. 48/12238, published Feb. 15, 1973, as abstracted in CA 79(26):147965h, there are disclosed rustproofing oil compositions obtained by combining zinc soap of wool fatty acid and barium sulfonate to mineral oil. Improved rustproofing properties and moisture- and weathering-resistances are reported but no reference is made to rustproofing compositions having enhanced thermal stability, even though preparation temperatures of 150°–170° C. were reported.

In the present state of the art, therefore, it is known that metal salts of alkaryl sulfonic acids have limited thermal stability, a feature which has hampered their use in high temperature applications. Furthermore, no way has been reported to formulate rustproofing and corrosion resistance imparting compositions for use at high temperatures employing metal sulfonates because of the lack of thermal stability of such compounds.

It has now been unexpectedly discovered that the thermal stability of metal sulfonates is remarkably and dramatically improved by the incorporation of relatively small quantities of alkali, alkaline earth metal or zinc salts of carboxylic acids. When incorporated into petroleum or synthetic base medium, this thermally stable combination is useful to inhibit rust and corrosion at higher temperatures than recognized in the prior art.

It has also been surprisingly discovered that metal sulfonates are effective solubilizing agents for alkali or alkaline earth metal salts of carboxylic acids in base oil media.

It is, accordingly, an object of the present invention to provide an effective method for preparing oil-soluble compositions comprising metal sulfonates and alkali or alkaline earth metal salts of carboxylic acids.

It is a further object of this invention to prepare an additive in concentrate form for improving the thermal stability of a wide variety of metal sulfonates, the additive comprising a metal sulfonate and an alkali or alkaline earth metal salt of a carboxylic acid.

It is also an object of this invention to provide a composition and a method for the preparation of a composition comprising a polyvalent metal sulfonate and an alkali or alkaline earth metal soap of a partially esterified alkenyl succinic acid in oil with exceptional thermal stability, and corrosion inhibiting characteristics.

It is a further object of the present invention to provide thermally stable corrosion and rust inhibiting compositions containing mixtures of metal alkaryl or petroleum sulfonates and alkali or alkaline earth metal salts of alkenyl succinic acids and/or alkali or alkaline earth metal salts of partially esterified alkenyl succinic acids for use in lubricating oil, grease, and the like.

The thermally stable sulfonates, additives, and lubricant compositions to be described further herein are substantially stable in the presence of moisture. There is no suggestion in the prior art that compositions like these will demonstrate enhanced thermal and/or moisture stability.

SUMMARY OF THE INVENTION

According to the present invention, there are provided concentrate compositions adapted for use as rust- and corrosion-inhibitors in a petroleum or synthetic base medium and capable of maintaining their sulfonate content at a temperature of 200° C. for 21 hours, said concentrates (A) comprising:

a blend of:

(a) an oil-soluble metal sulfonate; and (b) an alkali or alkaline earth metal or zinc salt of a carboxylic acid of, e.g., 6 to 50, preferably 10 to 30 carbon atoms; and (c) a carrier for said composition.

Quantitatively, experiments have shown that retention of metal sulfonate content under these severe thermal conditions of greater than about 90%, especially greater than about 95% and even greater than about 98% are easily obtained, in comparison with metal sulfonates alone as controls.

Most preferred features of the present invention are concentrate compositions, defined above, wherein component (a) comprises barium dinonylnaphthalene sulfonate and component (b) comprises a barium soap of tetrapropenylsuccinic acid and component (c) comprises a light mineral oil.

Further contemplated by this invention are methods for the preparation of a high temperature stable rust and corrosion inhibiting composition, said method comprising diluting a concentrate composition (A) comprising:

a blend of:

(a) an oil soluble metal sulfonate; and (b) an alkali or alkaline earth metal or zinc salt of a carboxylic acid; and (c) a carrier for said composition with sufficient base medium or base medium containing an oil-soluble metal sulfonate to provide a composition wherein components (a) and (b), together, comprise a minor proportion and are capable of imparting retention of greater than about 90% of the metal sulfonate content at a temperature of 200° C. for 21 hours.

Also contemplated in this invention are methods for providing metallic substrates with rust- and corrosion-inhibited surfaces stable at 200° C. for 21 hours, said method comprising:

A. preparing a concentrate (A) comprising:

a blend of:

(a) an oil soluble metal sulfonate; and (b) an alkali or alkaline earth metal or zinc salt of a carboxylic acid; and (c) a carrier for said composition;

B. diluting said concentrate with sufficient base medium or base medium containing an oil-soluble metal sulfonate to provide a composition wherein components (a) and (b), together, comprise a minor proportion;

C. applying a rust and corrosion inhibiting amount of said diluted concentrate to said metal surface; and D. exposing said metal surface carrying said composition to an environment normally sufficient to generate rust and corrosion at a temperature above about 150° C., and especially above about 180° C., for at least about one hour whereby rust and corrosion are substantially completely inhibited.

DESCRIPTION OF THE INVENTION

The metal sulfonates useful as component (A)(a) in the practice of this invention include a wide variety of compounds known to those skilled in the art. The alkaryl or polyalkaryl sulfonates may be prepared by following the teachings of U.S. Pat. Nos. 2,764,548, 3,957,859, and 4,201,681.

Aromatic organic substrates, such as aromatic petroleum fractions, as well as benzene and its analogs, e.g., alkylbenzenes, toluene, the xylenes, polyalkylbenzenes, and higher alkyl mono and di- and polysubstituted benzenes, such as nonyl and decyl and dodecyl, straight and branched chain-substituted benzenes and the corresponding naphthalenes, form sulfonates which are preferentially oil soluble (selectively extractable with organic hydrocarbon solvents, and the like), and sulfonates which are preferentially water soluble (and alcohol soluble, being selectively extractable with water and alcohols, and the like).

As is the case in U.S. Pat. No. 2,764,548, it is preferred to use a dinonylnaphthalene, the nonyl radicals of which are highly branched, and to use as a reaction solvent, a water-immiscible material selected from naphtha, hexane, heptane, octane, chlorinated hydrocarbons and the like. Procedures to make the starting materials are thoroughly described in the '548 patent.

Methods for forming aromatic mono- and disulfonic acids, e.g., dinonylnaphthalene mono- and polysulfonic acids are well described in the aforementioned U.S. Pat. No. 3,957,859. Typically, these alkyl or polyalkylaryl sulfonic acids will have molecular weights in the range of greater than 150–2,500 or greater, preferably 200, most preferably 350 or greater. Suitable sulfonates are those having an alkaryl group, e.g., alkylated benzene or alkylated naphthalene. Illustrative examples of such sulfonic acids are dioctyl benzene sulfonic acid, didodecyl benzene sulfonic acid, dinonyl naphthalene sulfonic acid, dilauryl benzene sulfonic acid, lauryl cetyl benzene sulfonic acid, polyolefin alkylated benzene sulfonic acids such as polybutylene alkylated benzene sulfonic acid and polypropylene alkylated benzene sulfonic acid. Especially preferred as aromatic sulfonates in the practice of this invention are dinonylnapthalene sulfonates, nonylnaphthalene sulfonates petroleum sulfonates, and the like.

The metal salt or sulfonate salt (A)(a) is a salt of an alkali metal from Group IA, e.g., sodium, potassium or lithium, and the like or an alkaline earth metal from Group IIA, e.g., calcium, barium, strontium, magnesium and the like or a metal from Group IIB, e.g., zinc, cadmium and the like. Sulfonates of metals in other groups, such as Groups IIIB, VIIIB and IB, e.g., titanium, vanadium, chromium, manganese, iron, cobalt, nickel, copper, and the like, as well as metals in the lanthanide series may also be employed.

The metal sulfonates of component (A)(a) may be formed by conventional methods known to those skilled in the art. The metal salts of aromatic sulfonic acids may be prepared by reacting an inorganic metal donor compound, e.g., metal hydroxide, metal oxide or metal carbonate with the alkyl or dialkyl or polyalkyl aromatic sulfonic acid. Thus for example, the reaction of any of barium hydroxide, barium oxide, zinc hydroxide, sodium hydroxide, sodium oxide, calcium hydroxide, calcium oxide and the like with the corresponding alkaryl sulfonic acid will yield suitable metal sulfonates. Suitable as component (A)(a) are polyvalent metal sulfonates such as barium dinonylnapthalene sulfonate, zinc dinonylnapthalene sulfonate, magnesium dinonylnaphthalene sulfonate, sodium petroleum sulfonate, barium alkylbenzene sulfonate, calcium dinonylnapthalene sulfonate, or a mixture of any of these. Especially preferred is barium dinonylnapthalene sulfonate which is available under the tradename NA-SUL ®BSN, King Industries Incorporated, Norwalk, Connecticut.

Contemplated for use as component (A)(a) are alkali or alkaline earth metal salts of carboxylic acids or metal soaps as they are also known. These also include the metal salts of alkenyl carboxylic acids, preferably alkenyl succinic acids as well as partially esterified carboxylic acids, e.g., alkenyl succinic acids The metals of component (A)(a) include elements from Group IA, e.g., lithium, Group IIA, e.g., barium and Group IIB, e.g., zinc.

The compounds useful as component (A)(a) can be obtained by any known method but are generally obtained by reacting an inorganic metal donor compound, e.g., lithium, barium or zinc and the like, with the appropriate carboxylic acid or partially esterified carboxylic acid, e.g., alkyl- or alkenyl succinic acid. Suitable as component (A)(a) are the barium soap of alkenyl succinic acid, the barium soap of a naphthenic acid, the lithium soap of an alkenyl succinic acid, the lithium soap of isostearic acid, the zinc soap of a naphthenic acid or a mixture of any of the foregoing. Especially preferred is the barium soap of tetrapropenyl succinic acid. One convenient method of preparation is to react the carboxylic acid or corresponding anhydride or partial ester with a metal donor, such as barium hydroxide monohydrate in the presence of a metal sulfonate (A)(a) and a small amount of lubricating oil at ambient or slightly elevated temperature.

The formed soap is then dehydrated by heating and the lubricating oil component added with stirring.

Preferred as component (A)(b) herein are the barium soap of an alkenyl succinic acid, a barium soap of a naphthenic acid, the lithium soap of an alkenyl succinic acid, the lithium soap of isostearic acid, the zinc soap of a naphthenic acid, and the calcium soap of an alkenyl succinic acid or of the partial alkyl ester of an alkenylsuccinic acid or a mixture of any of the foregoing. Especially preferred is the barium soap of tetrapropenylsuccinic acid.

The metal sulfonate (A)(a) and the alkali or alkaline earth metal salt of a carboxylic acid (A)(b) comprise a major proportion of the concentrate composition. For example, component (A)(a) may comprise an amount of from about 99 to about 20, preferably from about 80 to about 20 parts by weight, and component (A)(b) may comprise an amount of from about 1 to about 80, preferably from about 20 to about 80 parts by weight, per 100 parts by weight of (A)(a) and (A)(b) combined.

When formed as a concentrate, components (A)(a) and (A)(b) comprise preferably at least about 30% by weight, and especially preferably at least a major proportion of the compositions of this invention. Included as part of this concentrate is a carrier or diluent preferably in an amount of less than 70% by weight, and especially preferably less than about 50% by weight. Typically, the carriers can comprise polyalphaolefins, mineral oil, a wax, an ester, a halocarbon fluid, polyglycol, mixtures of any of the foregoing and the like. Preferred as carrier (A)(c) are crystalline wax, mineral spirits, kerosene Especially preferred as carrier (A)(c) is light mineral oil.

The mineral oils useful in the composition of this invention either as carriers or as base medium diluents will generally have a viscosity of at least about 30 SUS up to about 600 SUS at 100° F. (37.7° C.). More particularly the mineral oils will have a viscosity of from about 40 SUS to about 350 SUS at 100° F. (37.7° C.) and preferably from about 50 to about 150 SUS at 100° F. (37.7° C.). The term light mineral oil generally is accepted to mean an oil with a viscosity of less than about 150 SUS at 100° F.

The mineral oils can vary widely in refinement and they can be derived from a variety of crudes including paraffinic, naphthenic, asphaltic or mixed base. The mineral oils can be treated by any of the conventional refining methods including hydrogen treating, acid treating, extraction, etc. and blends or mixtures of such mineral oils can also be used.

As stated above, the carrier component (A)(c) will preferably comprise a minor proportion, i.e., less than about 50% of the concentrate composition that is formed by combining the metal sulfonate (A)(a) and the alkali or alkaline earth metal salt of a carboxylic acid (A)(b).

As will be exemplified hereinafter component (A)(a) of the concentrate composition most preferably comprises barium dinonylnapthalene sulfonate and component (A)(b) comprises a barium soap of tetrapropenylsuccinic acid and component (A)(c) comprises a light mineral oil.

In preferred methods in the practice of this invention, it is desirable to dilute the concentrate formed by (A)(a) and (A)(b) with base medium, e.g., a synthetic hydrocarbon fluid, esters, such as dioctyladipate and dioctylsuccinate, silicone fluids, halocarbon fluids, polyglycols, kerosene, petroleum solvents, and the like. Preferred are petroleum or synthetic base media, again, preferably mineral oil. When diluted components (A)(a) and (A)(b) will comprise a minor proportion of the composition, e.g., below about 50 parts, preferably from about 0.01 to about 30, most preferably from about 0.1 to 20 parts by weight, based on 100 parts by weight of (A)(a), (A)(b), (A)(c) and base medium, combined.

The diluted concentrate obtained with base medium can be employed in a number of applications including but not limited to rustproofing vehicles, as compressor oils, engine oils, gear oils, hydraulic fluids, rust preventives, slushing oils, synthetic lubricants and turbine oils. In short, these compositions can be employed in any application requiring rust and corrosion inhibitor. These compositions are particularly useful in high temperature applications, e.g., greater than 150° C., especially greater than 180° C., and even greater than 200° C. for at least one hour and prolonged periods, e.g., of even as long as 21 hours, or more.

In other preferred features of this invention, methods are contemplated for applying the diluted concentrate described above to metallic substrates to provide rust- and corrosion-inhibited surfaces that are stable at temperatures of about 200° C. for at least 20 hours.

DESCRIPTION OF THE PREFERRED EMBODIMENTS

The following examples are set forth herein to illustrate in more detail the preferred embodiments and to illustrate more clearly the principle and practice of this invention to those skilled in the art. These examples are not to be construed to limit the claims in any manner whatsoever.

TEST APPARATUS

An apparatus for exposing sulfonate samples to precisely controlled elevated temperatures was prepared as follows:

Heavy glass tubing with an outside diameter of 0.85 inches and a wall thickness of approximately 0.08 inches was formed into a series of test cells having the shape of glass tubes with ground glass taper joints to accommodate reflux condensers. The test material could then be placed in the tube, the reflux condenser placed in position, water cooling put through the condenser, and the tube inserted in a controlled temperature device. The device was a Brookfield Thermocel, manufactured by Brookfield Engineering Laboratories, Inc., of Stoughton, Mass. The Thermocel has a thermostatted well ½ inch in diameter, which accommodated the test cells very well with a snug fit. The temperature is dialed in and indicated with a digital read-out controller.

COMPARATIVE EXAMPLE 1 (CONTROL)

11.43 g of NA-SUL ®BSN, 50.5% active barium dinonylnaphthalene sulfonate in naphthenic oil, was placed in a test cell and exposed to a temperature of 200° C. in the Thermocel for 21 hours. The initial sample was a clear, brown viscous liquid. After the test, the sample was very dark and there were visible solids in the bottom of the test cell. Using the hyamine titration method described in ASTM method D-3049 the sulfonate content of the sample after exposure was found to be 24.6%. This represented a loss of 53.8% of the original sulfonate content.

EXAMPLE 1

(A) To a 1000 ml flask was charged 75 g of a 60% solution of tetrapropenyl succinic acid in naphthenic oil and 225 g of an over-based barium dinonylnapthalene sulfonate in light mineral oil with a total base number of 48 and a sulfonate content of 45.7%, King Industries, Inc., Norwalk, CT, U.S.A., NA-SUL ®BSB. The flask was set up with a heating mantle, stirrer, condenser, and thermometer. The contents of the flask were heated to 100° C. and held for one hour with stirring to react the excess base in the sulfonate with the acid to form a mixture of barium soap and unreacted acid. The reaction mixture was then heated to 150° C. and stripped under vacuum, yielding 287 g of product. The product was analyzed by acid-base titration and hyamine titration, and was found to contain 4.23% free carboxylic acid, 16.32% barium soap of tetrapropenyl succinic acid and 36.42% barium sulfonate. The acid value was 16.7. The concentrate according to this invention was a clear, viscous brown liquid.

(B) 16.07 g of concentrate was charged to a glass test cell as described in Comparative Example 1 and heated in the test apparatus to 200° C. The sample was held at 200° C. for more than 20 hours, specifically, 57.5 hours. After heating, the sample was analyzed. The soap content was 16.07% and the barium sulfonate content was 36.17% (99.3% retention). The color was darker than the original sample, but the sample was clear with no sediment.

EXAMPLE 2

A mixture of 1264 g of an overbased barium dinonylnaphthalene sulfonate in oil (as in Example 1), and 421.5 g of a commercially available alkenyl succinic acid with an acid value of 240 was heated with stirring at 100° C. for one hour and then stripped to yield 1654.8 g of concentrate. The concentrate was analyzed and found to contain 22.81% soap and 5.41% free carboxylic acid, based on consideration of the alkenyl succinic acid as 100% active, and 35.42% of barium sulfonate. The concentrate was tested in a series of 21-hour heat exposures at 215° C., 225° C., 240° C., 260° C. and 300° C. The barium soap content and barium sulfonate content were stable at all temperatures below 300° C. After exposure to 300° C., the soap level dropped to 14.94%, a loss of 6.1% of the original soap, and the sulfonate level dropped to 34.6%, a loss of 0.8% actual, or 2.3% relative to the original sulfonate. There was no sediment after the tests. The color darkened, particularly at the highest temperatures, but the darkening affects were in no way as severe as in the unmodified sulfonate at 200° C. in Comparative Example 1.

In the following comparative example, the thermal stability of neutral barium dinonylnaphthalene sulfonate in oil in dilute form was determined.

COMPARATIVE EXAMPLE 2

10.0 grams of neutral barium dinonylnaphthalene sulfonate, NA-SUL ®BSN, U.S. Pat. No. 4,164,474, was diluted to 100 g in light mineral oil, Telura ®415, Exxon Co., a 75 sec solvent-extracted naphthenic oil. 15.0 gram samples were charged to the test apparatus and exposed for 21 hours at 150° C., 175° C., and 200° C. The test samples were analyzed before and after exposure:

| EXPOSURE | % BARIUM SULFONATE | ACID VALUE | SULFONATE LOSS, %, RELATIVE |
|---|---|---|---|
| Original sample | 5.12 | 0.24 | 0.00 |
| 21 hours 150° C. | 4.60 | 1.10 | 10.2 |
| 21 hours 175° C. | 3.10 | 2.50 | 39.5 |
| 21 hours 200° C. | 0.60 | — | 88.3 |

The results above indicate that dilute neutral barium dinonylnaphthalene sulfonate, does not maintain stability as well as the solvent-free neutral barium dinonylnaphthalene sulfonate which was tested in Comparative Example 1.

EXAMPLE 3

Following the procedure of Example 2, the neutral barium dinonylnapthalene sulfonate of comparative Example 2 was stabilized with a barium soap of tetrapropenyl succinic acid. The concentrate was then diluted with naphthenic oil, to 15.85% of the initial concentrate by weight, and exposed to temperatures of 200° C. and 250° C. in the test apparatus for 21 hours. The samples were both darker, but bright and clear after exposure The results are set forth below:

| EXPOSURE TEMPERATURE | INITIAL % Ba SULFONATE | AFTER EXPOSURE % Ba SULFONATE | SULFONATE LOSS %, RELATIVE |
|---|---|---|---|
| 200° C. | 5.05 | 5.07 | (−0.40) |
| 250° C. | 5.26 | 5.11 | 2.85 |

Examples 1, 2 and 3 indicate that the barium soaps were completely soluble in the mixture of oil and barium dinonylnaphthalene sulfonate and stabilized the latter at temperatures above 180° C., specifically, at 200° C. and above for more than one hour, specifically for 20 hours or more.

The following example describes the preparation of a clear, single-phase concentrate of barium soap in barium dinonylnaphthalene sulfonate and polyalphaolefin fluid, starting with neutral barium sulfonate in heptane.

EXAMPLE 4

The following components were charged to a 2 liter flask set up with agitator, thermometer, condenser and heating mantle:

| | |
|---|---|
| 709 g | barium dinonylnaphthalene sulfonate (DNNS) in heptane, 47.6% active; |
| 315 g | polyalphaolefin fluid (PAO); |
| 60.7 g | barium hydroxide monohydrate; and |
| 250 g | of a commercially available alkenyl succinic acid with an acid value of 240. |

The mixture was brought to reflux temperature, 90° C., while agitating, and was maintained at reflux for 3 hours. The condenser configuration was then modified for stripping and the product was dried by azeotroping water and heptane and returning the heptane to the flask. Finally, the heptane was stripped under vacuum (pressure 5 Torr) to 150° C. The clear concentrate was then put through a polishing filter and analyzed. Results are set forth below:

| | |
|---|---|
| Acid value to phenolphthalein end point: | 16.48 |
| Soap Content: | 25.36% |
| Sulfonate Content: | 34.12% |

The following example illustrates the preparation of a clear, totally miscible solution of barium soap in barium dinonylnaphthalene sulfonate and naphthenic oil starting with the neutral barium sulfonate in oil.

EXAMPLE 5

To a 2 liter flask was charged 840 g of barium DNNS in heptane, 40.16% active; 60.6 g barium hydroxide monohydrate, 142 g tetrapropenylsuccinic anhydride, and 360 g of naphthenic oil. The flask was set up with stirrer, reflux condenser, Claisen adapter, thermometer, and heating mantle. The mixture was heated with stirring to reflux temperature and held at reflux for ½ hour. Then the condenser was modified by adding a trap, and water was removed by azeotropic distillation. The clear heptane solution was filtered and then the heptane was stripped under vacuum to 150° C. pot temperature. The clear viscous concentrate contained 35.89% barium sulfonate and was adjusted to 33.68% sulfonate by adding additional oil. The final barium soap content was 19.06%.

EXAMPLE 6

A clear, viscous solution containing 35.47% barium DNN sulfonate and 15.52% lithium isostearate in naphthenic oil was prepared by combining isostearic acid, lithium hydroxide, and naphthenic oil in heptane. The solution was heated to form a viscous, turbid soap dispersion and then the metal sulfonate was added. Water was removed by azeotropic distillation. The solution was filtered, and hexane was stripped at 150° C. under vacuum. 16.56 g of concentrate was heated for 21 hours at 200° C. in the thermal test apparatus. The sulfonate content after exposure was 35.62%, compared to 35.47% initially.

EXAMPLE 7

Following the procedure of Example 6, but varying the concentration percentages, a clear, viscous concentrate was prepared. Analysis of the mixture indicated that it contained 45.70% barium sulfonate and 5.54% of lithium soap. After testing for 21 hours at 200° C. in the Test Apparatus, the sulfonate content was determined to be 45.7% and the soap content was 5.51%.

The results of the foregoing Examples 6 and 7 indicate that barium sulfonates are thermally stabilized by lithium soaps and that only a small amount of the soap is required.

The following example illustrates the preparation and testing of a 5% lithium isooctadecenylsuccinate mixture with a barium sulfonate.

EXAMPLE 8

The following ingredients were combined in a 1-liter flask set up as described in Example 4 and blended:

| | |
|---|---|
| 107.1 g | isooctadecenylsuccinic anhydride |
| 232.6 g | neutral barium dinonylnaphthalene sulfonate (50% active in mineral oil) |
| 116.3 g | naphthenic oil |
| 150 g | heptane |

In a separate flask, 25.7 g of lithium hydroxide monohydrate was dissolved in 125 g of water and then added to the flask. The mixture was refluxed for one hour, water was stripped, and the mixture was filtered. Heptane was stripped under vacuum to 150° C. The concentrate was analyzed and found to contain 25.32% barium sulfonate and 24.72% lithium isooctadecenyl succinate.

(a) Thermal aging test. 80 g of the mixture obtained above was mixed with 322 g of neutral barium dinonylnapthalene sulfonate, heated with stirring to 95° C., held 5 minutes, and then cooled. The final mixture contained 45.65% sulfonate and 5.10% lithium soap. 16 g of this mixture was charged to the test cell and held for 20 hours at 200° C. After aging, the product contained 45.38% sulfonate and 5.00% soap.

The development of color in unstabilized sulfonates during heat aging is striking when compared with sulfonates which have been heat stabilized by the addition of metal soaps. For comparison, the ASTM dilution colors and Gardner colors of neutral barium dinonylnaphthalene and the stabilized barium sulfonate of this Example 8 before and after heat-aging are shown in the table below:

(b) Gardner Colors, 2.25% by Volume in Heptane

| | UN-TREATED | STABILIZED (this invention) |
|---|---|---|
| Before Exposure: | 2.5 | 2.5 |
| After Exposure, 200° C./20 hrs. | 14.0 | 5.0 |

Is is seen that the color stability is greatly improved in accordance with this invention.

The barium sulfonate/barium soap concentrate of Example 1 is used to stabilize a neutral sodium petroleum sulfonate in the following example.

EXAMPLE 9

The following components were mixed:

| | |
|---|---|
| 2 g | barium concentrate of Example 1; |
| 8 g | of a commercial neutral sodium petroleum sulfonate containing 62% sulfonate content (Morco H62, Marathon Morco) |
| 90 g | of a light mineral oil. |

This mixture was heated for 21 hours at 200° C. and showed a sulfonate retention of 99.5%.

In a control experiment without stabilization, 8% of the sodium sulfonate in oil was exposed to 200° C. for 21 hours and it showed a 14% sulfonate retention.

The following example demonstrates the stabilization of a neutral magnesium dinonylnaphthalene sulfonate using a concentration containing calcium sulfonate and a calcium soap.

EXAMPLE 10

A mixture of 30% calcium dinonylnaphthalene sulfonate and 30% calcium soap of the half methyl ester of hexadecenyl succinic acid in light mineral oil was prepared following the method of Example 5. 10.1 grams of this concentrate was combined with 39.95 grams of a 50% active solution of magnesium dinonylnaphthalene sulfonate in light mineral oil. 15.13 grams of this mixture was further diluted with 100.17 grams of a light mineral oil to approximate a typical end-use concentrate. The total percent sulfonate as prepared was 6.99%. After 21 hours of heating at 200° C. the percent sulfonate was 6.67%, a retention of 95.4% of the original sulfonate.

In a control experiment, 19.37 grams of the same 50% active magnesium dinonylnaphthalene sulfonate in mineral oil was diluted with additional mineral oil to 128.83 grams. When tested for 21 hours at 200° C. the sulfonate retention was found to be 32.5%.

The procedure of Example 9 was used to stabilize calcium dinonylnaphthalene sulfonate with the calcium soap of the partial methyl ester of dodecenyl succinic acid.

EXAMPLE 11

A mixture of calcium dinonylnaphthalene sulfonate and the calcium soap containing 5.04% calcium sulfonate was heated for 21 hours at 200° C. After heating the percent sulfonate was found to 5.04%. The sulfonate retention was 100%.

In the next example zinc dinonylnaphthalene sulfonate was stabilized with barium naphthenate and also with zinc naphthenate.

EXAMPLE 12

In the control experiment, zinc dinonylnaphthalene sulfonate at a concentration of 8% in light mineral oil was heated for 21 hours at 175° C. and showed a sulfonate retention of 73.8%.

When a mixture of 8% of the zinc dinonylnaphthalene sulfonate and 5% of a 50% active barium naphthenate was diluted with mineral oil and subjected to the same exposure the sulfonate retention was 92.3%. When another experiment was run substituting zinc naphthenate for barium naphthenate, and the test temperature was raised to 200° C. for 21 hours the percent sulfonate retention was 97.03.

In the next example, a neutral barium alkylbenzene sulfonate was stabilized with the barium sulfonate/barium soap concentrate described in Example 9.

EXAMPLE 13

202.5 grams of a 50% active barium alkylbenzene sulfonate in oil, (sulfonate equivalent weight 517.5) was combined with 49.83 grams of the barium sulfonate/barium soap concentrate of Example 1 and blended. This mixture was treated for 21 hours at 200° C. Before exposure, the sulfonate content was 46.72% and after exposure, 46.70%. The sulfonate retention was 100%.

The above-mentioned patents and test methods are incorporated herein by reference.

Many variations will suggest themselves to those skilled in the art in light of the above detailed description. For example, instead of using barium, calcium, magnesium, and zinc dinonylnaphthalene sulfonates and sodium alkylbenzene sulfonate as component (a)(i), sulfonates of other metals such as lead and lithium can be employed. Instead of using barium, lithium, calcium and zinc as the metals in component (a)(ii), other metals such as sodium, potassium and strontium can be used. Instead of dinonylnaphthalene sulfonate, alkylbenzene sulfonate or petroleum sulfonate in component (a)(i) other sulfonates can be used, such as octyl, decyl, undecyl, dodecyl and the like can be used. Likewise, sulfonated diphenylalkanes can be used. Obviously, instead of diacids, the corresponding anhydrides and half esters can be used. Instead of mineral oil and polyalphaolefin as component (b), other carriers, such as microcrystalline waxes, dioctyl adipate, silicone oils, and the like, can be substituted. Other conventional additives can be added in conventional amounts, such as antioxidants, extreme pressure additive, viscosity index modifiers, dispersants and the like can be used. All such obvious variations are within the full intended scope of the appended claims.

We claim:

1. A rust- and corrosion-inhibiting composition comprising (A) a homogeneous concentration of:

(a) an oil soluble metal sulfonate;

(b) an alkali or alkaline earth metal or zinc soap of a partially esterified alkyl or alkenyl succinic acid or a mixture of any of the foregoing;

(c) a carrier; and (B) a diluting amount sufficient to provide a composition wherein components (A)(a) and (A)(b) together comprise a minor proportion of said composition, of a base medium which may be the same as or different than (A)(c) or a base medium which may be the same as or different than (A)(c), containing an oil soluble metal sulfonate which may be the same as or different than (A)(a);

wherein components (A)(a) and (A)(b), together, are capable of imparting retention of greater than about 90 percent of the metal sulfonate content at a temperature of 200° C. for 22 hours and wherein said concentration (A) comprises a minor amount of said composition.

2. A composition as defined in claim 1 wherein component (A)(a) comprises an oil soluble metal salt of an alkylarylsulfonic acid or petroleum sulfonic acid having a molecular weight above about 350.

3. A composition as defined in claim 1 wherein component (A)(a) comprises an alkali metal or an alkaline earth metal or zinc salt of a dialkylarylsulfonic acid.

4. A composition as defined in claim 3 wherein component (A)(a) comprises a salt of a dinonylnaphthalene sulfonic acid.

5. A composition as defined in claim 1 wherein component (A)(a) comprises barium dinonylnaphthalene sulfonate, zinc dinonylnaphthalene sulfonate, magnesium dinonylnaphthalene sulfonate, sodium petroleum sulfonate, barium alkylbenzene sulfonate, calcium dinonylnaphthalene sulfonate, or a mixture of any of the foregoing.

6. A composition as defined in claim 1 wherein component (A)(b) is selected from the group consisting of an alkali or alkaline earth metal or zinc soap of a partially esterified alkyl or alkenyl succinic acid having from about 6 to about 50 carbon atoms, or a mixture of any of the foregoing.

7. A composition as defined in claim 1 wherein component (A)(b) is selected from the group consisting of a barium soap of a partially esterified alkenyl succinic acid, a lithium soap of a partially esterified alkenyl succinic acid, a calcium soap of a partially esterified alkenyl succinic acid, or a mixture of any of the foregoing.

8. A composition as defined in claim 1 wherein said carrier (A)(a) is selected from the group consisting of a wax, an ester, a halocarbon fluid, a polyalphaolefin, a polyglycol, a mineral oil, a grease or a mixture of any of the foregoing.

9. A composition as defined in claim 8 wherein said carrier (A)(a) comprises a mineral oil.

10. A composition as defined in claim 1 wherein said base medium (B) comprises a synthetic hydrocarbon fluid, an ester, a silicone fluid, a halocarbon fluid, a polyglycol, kerosene, a petroleum solvent, a mineral oil or a combination of any of the foregoing.

11. A composition as defined in claim 10 wherein said base medium (B) comprises a synthetic hydrocarbon fluid, an ester or a mineral oil.

12. A composition as defined in claim 1 wherein component (A)(a) comprises from about 99 to about 20 parts by weight and component (A)(b) comprises from about 1 to about 80 parts by weight per 100 parts by weight of (A)(a) and (A)(b) combined.

13. A composition as defined in claim 12 wherein said component (A)(a) comprises from about 80 to about 20 parts by weight and component (A)(b) comprises from about 20 to about 80 parts by weight per 100 parts by weight of (A)(a) and (A)(b) combined.

14. A composition as defined in claim 1 wherein components (A)(a) and (A)(b), combined, comprise from about 0.01 to about 30 parts by weight per 100 parts by weight of components (A)(a), (A)(b), (A)(c) and (B) combined.

15. A composition as defined in claim 14 wherein components (A)(a) and (A)(b), combined, comprise from about 0.1 to about 20 parts by weight per 100 parts by weight of components (A)(a), (A)(b), (A)(c) and (B) combined.

16. A composition as defined in claim 1 comprising a compressor oil.

17. A composition as defined in claim 1 comprising an engine oil.

18. A composition as defined in claim 1 comprising a gear oil.

19. A composition as defined in claim 1 comprising a grease.

20. A composition as defined in claim 1 comprising a hydraulic fluid.

21. A composition as defined in claim 1 comprising a slushing oil.

22. A composition as defined in claim 1 comprising a synthetic lubricant.

23. A composition as defined in claim 1 comprising a turbine oil.

24. A method for the preparation of a rust- and corrosion-inhibiting composition comprising intimately mixing a homogeneous concentrate (A) of:

(a) an oil soluble metal sulfonate;

(b) an alkali or alkaline earth metal or zinc soap of a partially esterified alkyl or alkenyl succinic acid, or a mixture of any of the foregoing;

(c) a carrier; and (B) a diluting amount sufficient to provide a composition wherein components (A)(a) and (A)(b) together form a minor proportion of said composition, of a base medium which may be the same or different than (A)(c) or a base medium which may be the same as or different than (A)(c) containing an oil soluble metal sulfonate which may be the same as or different than (A)(a);

wherein components (A)(a) and (A)(b), together, are capable of imparting retention of greater than about 90 percent of the metal sulfonate content at a temperature of 200° C. for 21 hours and wherein said concentrate (A) comprises a minor amount of said composition.

25. A method for the preparation of a rust- and corrosion-inhibiting composition comprising diluting a concentrate composition (A) comprising (a) an oil soluble metal sulfonate;

(b) an alkali or alkaline earth metal or zinc soap of an alkyl or alkenyl succinic acid, a partially esterified alkyl or alkenyl succinic acid, or a mixture of any of the foregoing; and (c) a carrier; with (B) a diluting amount sufficient to provide a composition wherein components (A)(a) and (A)(b) together form a minor proportion of said composition of a base medium which may be the same as or different than (A)(c) or base medium which may be the same as or different than (A)(c), containing oil soluble metal sulfonate which may be the same as or different than (A)(a);

to provide a composition wherein components (A)(a) and (A)(b), together, are capable of imparting retention of greater than about 90 percent of the metal sulfonate content at a temperature of about 200° C. for 21 hours and wherein said concentration (A) comprises a minor about of said composition.

* * * * *